United States Patent [19]

Truitt

[11] 4,192,072

[45] Mar. 11, 1980

[54] PENDULUM DEVICE

[76] Inventor: Thomas E. Truitt, P.O. Box 251, Polo, Mo. 64671

[21] Appl. No.: 880,583

[22] Filed: Feb. 23, 1978

[51] Int. Cl.[2] ..... B43L 11/00

[52] U.S. Cl. ..... 33/27 L

[58] Field of Search ..... 33/10, 24 B, 27 L; 35/19 R; 46/131, 237, 238, 242

[56] References Cited

U.S. PATENT DOCUMENTS 3,496,641 2/1970 Mills ..... 33/27 L

*Primary Examiner*—Charles E. Phillips

*Attorney, Agent, or Firm*—D. A. N. Chase

[57] ABSTRACT

In a kinetic sculpture apparatus, the lower end of a pendulum provides a scribe having a tapered tip that penetrates the surface of a bed of fine, particulate material to make an intricate pattern in the bed whose configuration is determined by the location of the pendulum's primary horizontal axis, the position from which the pendulum is released, and the depth of penetration of the tip of the scribe. The suspension system for the pendulum includes an arch which spans a pair of standards disposed on opposite sides of the receiver that contains the bed of material. The pendulum assembly is mounted above a baseplate by a ball and socket connection which permits the entire assembly to be tilted in any direction to move the at-rest point of contact of the scribe away from the center of the bed to any quadrant or region thereof where a subpattern is to be sculptured. Additionally, the receiver is independently rotatable about a vertical (or slightly inclined) axis through a selected angular displacement to permit the sculpturing of angularly spaced repeat patterns. A highly stable suspension is provided by a disc-shaped rocker element having a central slot therein through which the arch extends. Bed shaping is provided by a dish-shaped cover for the receiver having a convex lower surface.

16 Claims, 10 Drawing Figures

Fig. 5.
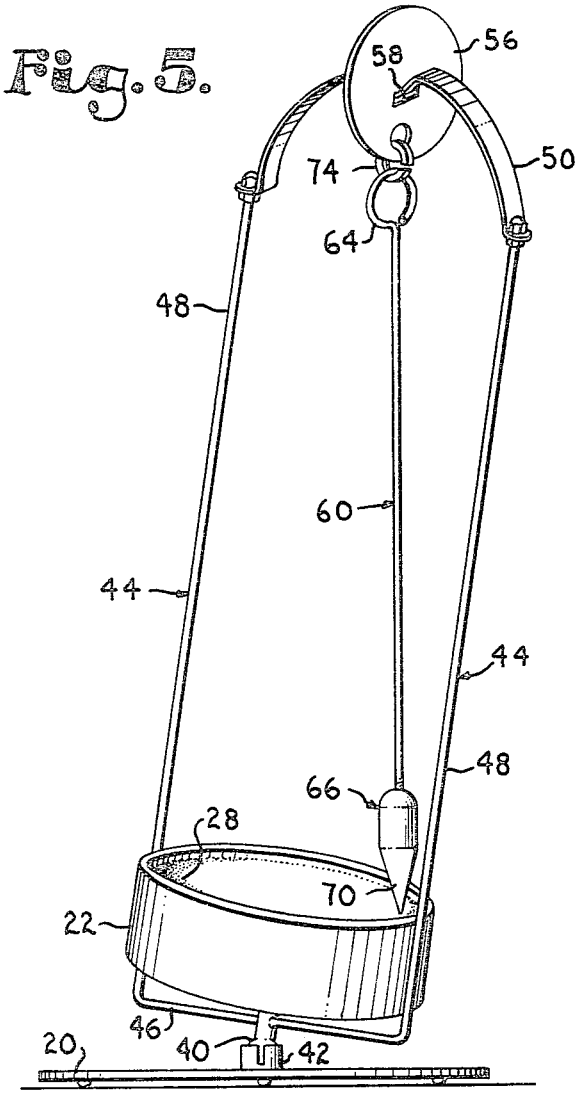
Fig. 8.
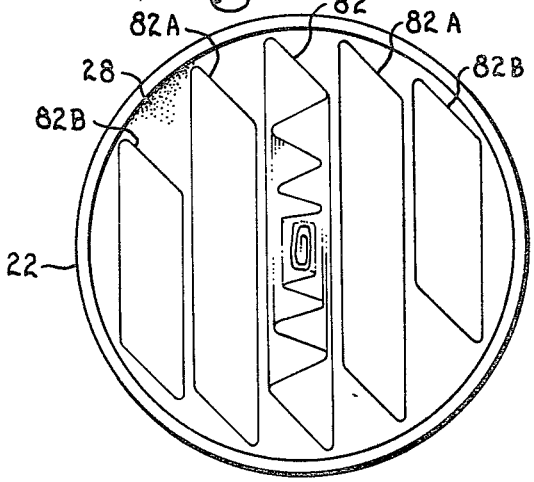
Fig. 9.
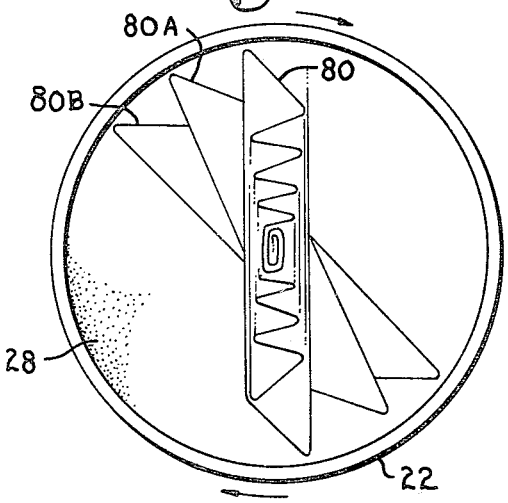
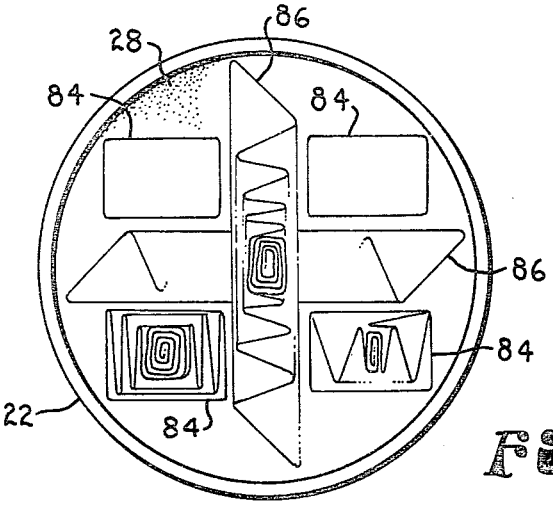
Fig. 10.

PENDULUM DEVICE

CROSS-REFERENCE

U.S. Pat. No. 4,067,111, issued to Thomas E. Truitt on Jan. 10, 1978.

This invention relates to improvements in kinetic sculpture apparatus of the type employing a pendulum to inscribe patterns in a bed of fine, particulate material and, in particular, to improvements in the apparatus described and illustrated in the above-referenced U.S. Pat. No. 4,067,111.

Although the pendulum devices disclosed in said patent provide a kinetic sculpture apparatus which has high viewer satisfaction and has been widely accepted and used, viewers desire maximum flexibility and an apparatus that will permit them to express their creativity to the maximum. The more intricate and original the patterns capable of being produced, the greater the satisfaction of a serious and discriminatory viewer. Furthermore, aside from the artistic aspects, in some instances it is desired that the mechanism have greater stability and resistance to accidental jarring which could dislodge the rocker elements of the pendulum suspensions disclosed in said patent and used in practice heretofore.

It is, therefore, a general object of the present invention to provide an improved kinetic sculpture apparatus which permits great flexibility in the patterns that can be sculptured, including the ability to create subpatterns, repeat patterns and compositions as the viewer's creativity may demand.

In the furtherance of the foregoing object, it is an important aim of this invention to provide apparatus as aforesaid in which the bed of material or design area and the pendulum structure may be tilted in any direction to relocate the scribe of the pendulum so that subpatterns or parallel patterns may be sculptured in quadrants or other defined regions of the design area as the viewer may wish.

Another important object of the invention is to provide apparatus as aforesaid in which the bed or design area may be independently rotated about a generally upright axis through an annular displacement as selected by the viewer, thereby permitting the sculpturing of angularly spaced repeat patterns such as star type and sunburst.

Still another important object of the invention is to provide apparatus as aforesaid constructed such that the primary horizontal axis of swinging movement of the pendulum remains at the same elevation during swinging of the pendulum so that, with proper shaping of the bed beforehand, the depth of penetration of the tip of the scribe will be uniform throughout the pattern.

Yet another important object of the invention is to provide apparatus as aforesaid which employs a rocker element in the pendulum suspension that is resistant to accidental dislodging or disengagement, and that is particularly suitable in a tiltable pendulum device of this type where, for creative sculpturing, the primary horizontal axis is shifted to various positions to relocate the scribe as desired by the viewer.

Furthermore, specific objectives of this invention include the provision of multiple standards to support the pendulum suspension and provide for uniform penetration of the scribe into the bed of material, a universal connection between the material receiver and a baseplate therebelow to permit tilting of the pendulum assembly in any direction, a special tapered mount for the independently rotatable receiver, and a cover for the receiver with a convex lower surface to shape the bed prior to sculpturing.

DESCRIPTION OF THE DRAWINGS

FIG. 5 is a perspective view on a smaller scale showing the asembly in an extreme tilted position;

FIG. 8 is a plan view exclusively of the receiver showing parallel patterns made in the design area, resulting from the use of the tilting feature;

FIG. 9 is a view similar to FIG. 8 but showing repeat patterns made by rotating the receiver in angular increments; and FIG. 10 is a view similar to FIGS. 8 and 9 and shows a composite pattern formed by repeat patterns and subpatterns.

DETAILED DESCRIPTION

Figure 1:
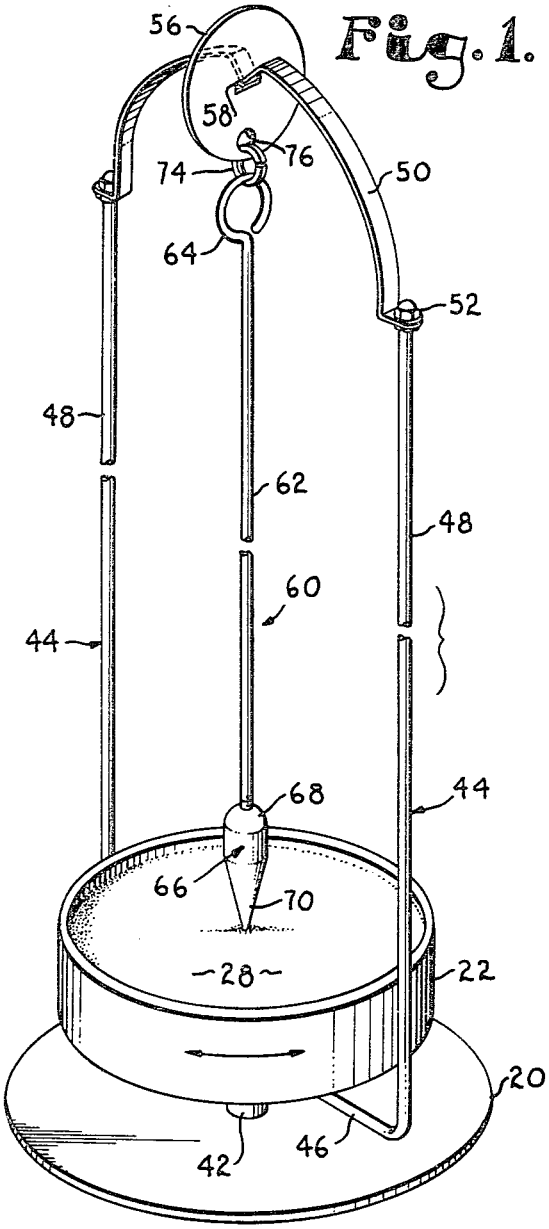
FIG. 1 is a perspective view of the apparatus of the present invention.

Referring first to FIGS. 1–7, the kinetic sculpture apparatus there illustrated has a circular baseplate 20 adapted to rest on a floor, tabletop or stand (not shown) to accommodate the height of the apparatus and the preference of the viewer. A receiver 22 is mounted above the baseplate 20 and is a relatively short, cylindrical vessel having a circular bottom 24 from which a central boss 26 depends. The receiver 22 contains a bed 28 of fine, particulate material, preferably fine glass beads. The bed 28 is initially smoothed to present a concave upper surface, and such shape may be imparted through the use of a dish-shaped cover 30 (FIG. 3) on the receiver 22 having a convex lower surface 32.

The boss 26 on the receiver bottom 24 has a normally vertically extending, tapered opening 34 therein (FIG. 6) presented by a frustoconical internal wall. A mating, tapered stud 36 is received within the frustoconical opening 34 and forms the upper end of a stem 38 which depends from boss 26 and is provided with a ball 40 at its lower end. An upstanding projection 42 on baseplate 20 is located at the center of the baseplate and forms a socket complementally receiving the ball 40 as is clear in FIG. 6. Accordingly, a ball and socket connection is provided between the receiver 22 and the baseplate 20.

A pair of horizontally spaced standards 44 extend upwardly adjacent diametrically opposed sides of the receiver 22 and support the suspension system of the pendulum as will be discussed. Each of the standards 44 is of L-shaped configuration to present a lower, generally horizontal arm 46 rigid with the stem 38 and an upright 48 extending from the arm 46 to such suspension system. The arms 46 of the two standards 44 radiate from the stem 38 in opposite directions clear of the receiver 22, and the uprights 48 extend upwardly therefrom after a right angle bend as is clear in FIG. 3. Accordingly, each of the standards 44 is of one-piece construction and may be formed from heavy rod stock.

The suspension system is provided by an arch 50 formed by a flat, elongated member spanning the upper ends of the standards 44 and secured thereto by nuts 52. A V-shaped portion 54 is formed in the center of the arch 50 and receives a disc-shaped rocker element 56 which is disposed in an upright attitude. The element 56 is a thin plate having a central, horizontal slot 58 therein through which the arch member 50 extends, the element 56 resting in the bottom of the V-shaped portion 54 with the upper edge of the slot 58 in line contact therewith. Such line contact of the rocker element 56 with the arch member 50 defines the primary horizontal axis of swinging movement of the pendulum 60.

The pendulum 60 comprises a rod 62 having an upper end 64 formed into a loop for a purpose to be discussed. The weight 66 of the pendulum 60 forms the lower end thereof, the lower end of rod 62 being externally threaded and received in a tapped opening (not shown) in the head 68 of weight 66. The head 68 is cylindrical with a rounded top, and therebeneath the weight 66 is conical to form a scribe 70 with a tapered tip 72 (see particularly FIG. 2).

The loop 64 at the upper end of the pendulum 60 extends through an annular component in the nature of a split ring 74 which, in turn, extends through a circular opening 76 in the rocker element 56 directly below the slot 58 and closely spaced from the circumferential periphery of the element 56. As best seen from a comparison of FIGS. 3 and 4, the ring 74 has a beveled inside surface forming a sharp, circular inner edge 78. Since the disc-shaped rocker element 56 is relatively thin, the edge 78 is in essentially point contact therewith within the circular opening 76 as is clear in FIG. 4. The loop 64 and the ring 74 provide a two-component, secondary rotary coupling between the pendulum 60 and the rocker element 56 to enable the scribe 70 to form intricate patterns in the bed 28 of particulate material in a manner as fully described in the aforesaid U.S. Pat. No. 4,067,111.

OPERATION

The manner in which a pattern is inscribed in the bed 28 by the tip 72 of the scribe 70 is identically the same as described and illustrated in the aforesaid patent. Accordingly, said U.S. Pat. No. 4,067,111 is incorporated herein by reference as may be necessary for a full and complete understanding of the general operation of the apparatus of FIGS. 1–7 herein.

The present invention is capable of inscribing repeat patterns and subpatterns in a most creative manner as will now be discussed. Initially, prior to sculpturing, the bed 28 should be properly shaped and this may be accomplished through the use of the cover 30 since the convex lower surface 32 thereof has a curvature corresponding to the curve described by the tip 72 of the pendulum 60 as it swings back and forth. Due to the employment of multiple standards (the pair of standards 44) to support the suspension system of the pendulum apparatus, the primary horizontal axis is maintained at the same elevation during swinging of the pendulum in contrast to the use of a single standard which would allow the axis to rise and fall as the single standard sways with the directional pull of the pendulum. By eliminating such rise and fall and maintaining the horizontal axis at the same elevation, the depth of penetration of the tip 72 is uniform and, therefore, the lines of the inscribed pattern are of uniform depth and width.

Figure 2:
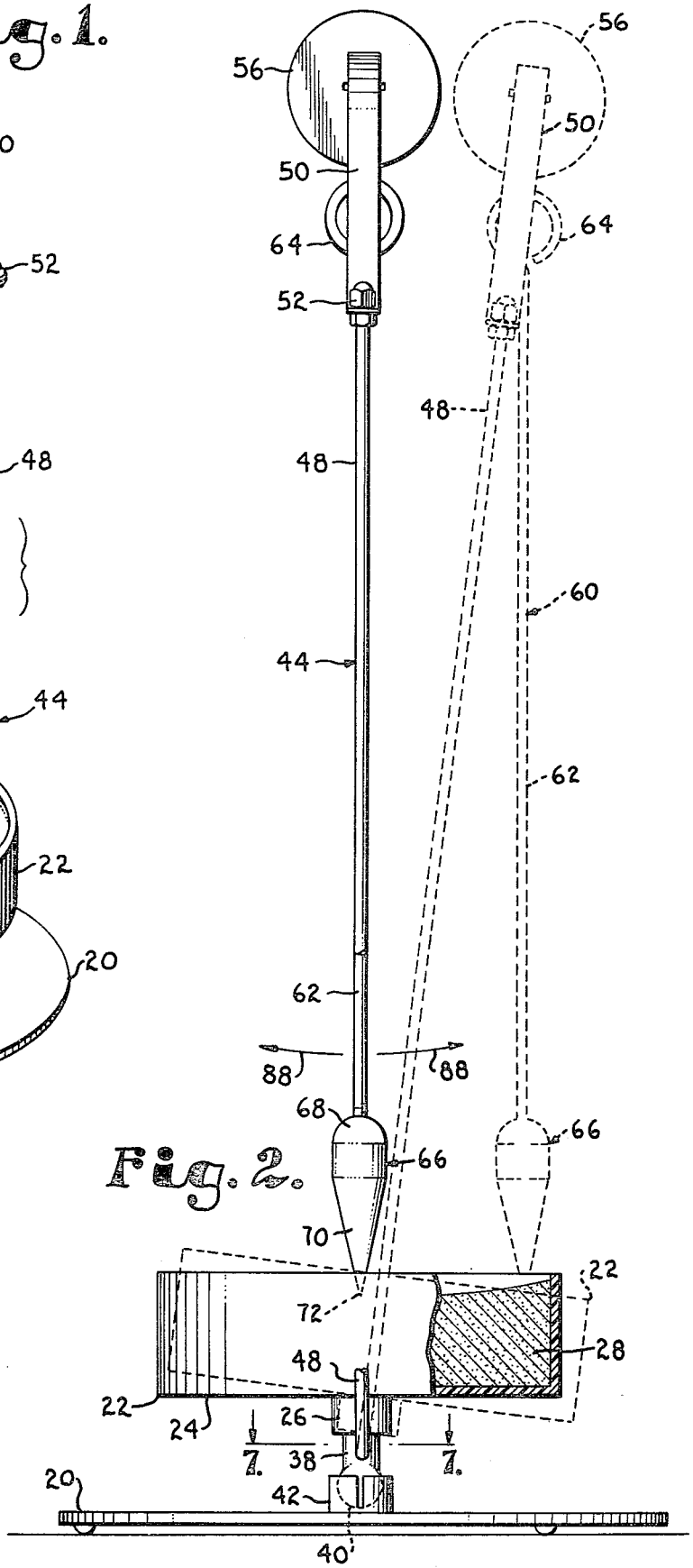
FIG. 2 is a side elevational view of the apparatus with a portion of the standard nearest the viewer being broken away for clarity, the pendulum assembly being shown in a tilted position in broken lines.
Figure 4:
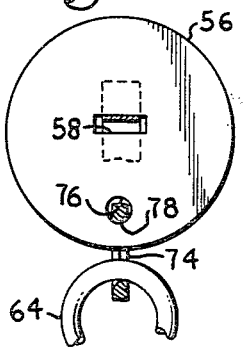
FIG. 4 is a detail view of the disc-shaped rocker element.
Figure 3:
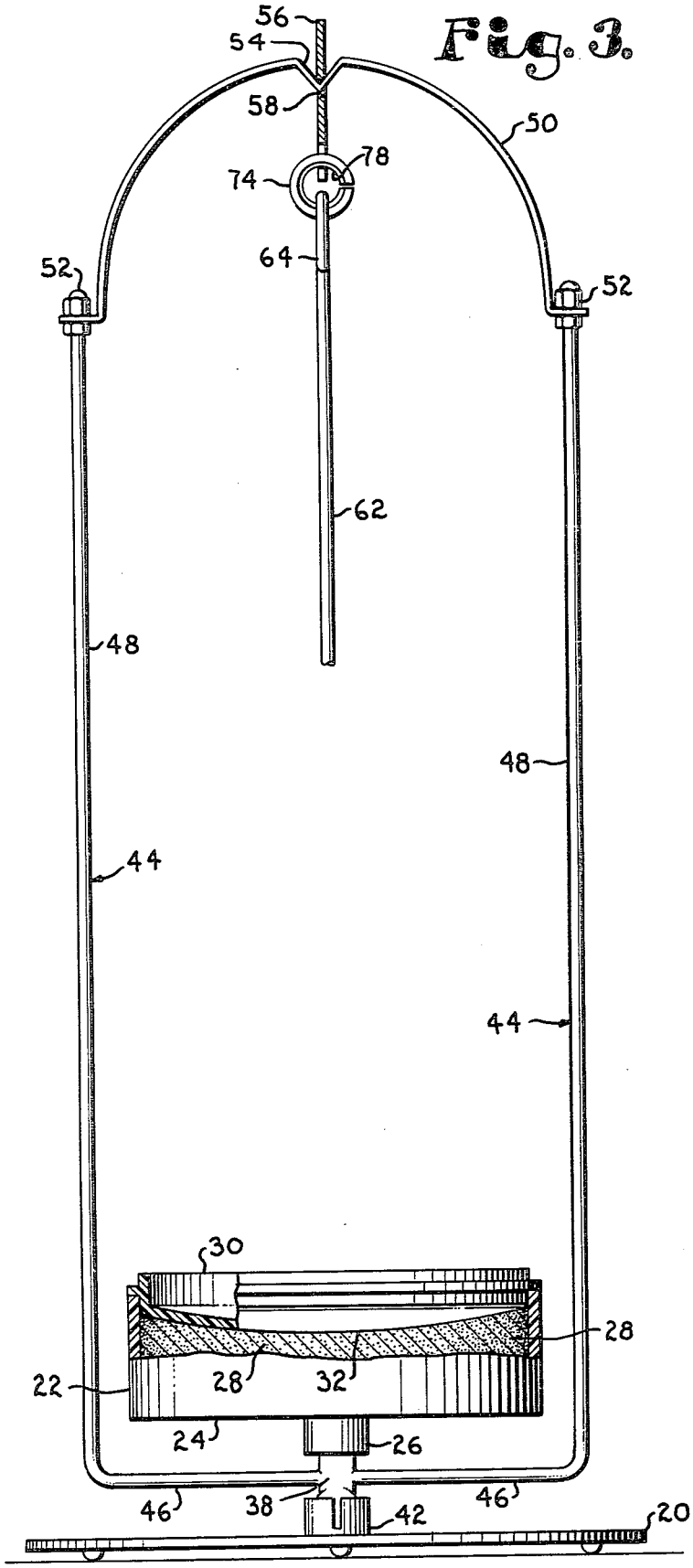
FIG. 3 is a front view of the apparatus showing the cover installed on the receiver, certain parts being broken away and revealed in cross-section for clarity and to reveal details of construction.
Figure 6:
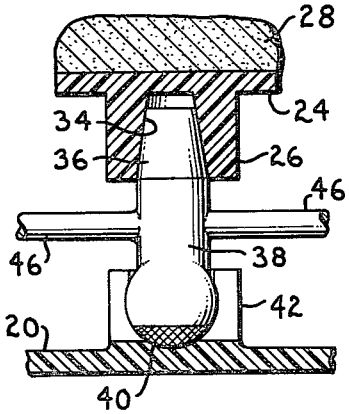
FIG. 6 is a detail view of the ball and socket connection and associated mounting parts between the receiver and baseplate.
Figure 7:
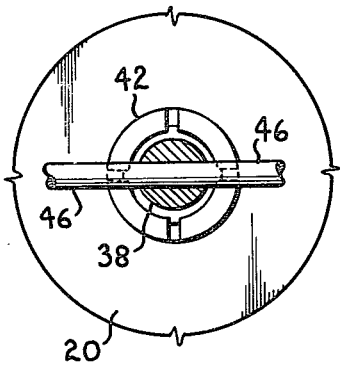
FIG. 7 is an enlarged, cross-sectional view taken along line 7—7 of FIG. 2.

The subpattern and repeat pattern capabilities are provided by the ball and socket connection between the receiver 22 and the baseplate 20, and the taper mount of the receiver 22 that permits the latter to rotate about a central, upright axis to desired angular positions. The broken lines in FIG. 2 illustrate essentially maximum tilt of the pendulum assembly provided by movement of the ball 40 within the mating socket. The tolerances should be such that the interference fit of the ball and socket components will maintain the pendulum assembly in the desired tilted position until it is moved to another position by the viewer. Note in FIG. 5 where maximum tilt is illustrated, and that by virtue of the ball 40 the viewer may tilt the assembly in any desired direction.

In FIG. 1 and in FIG. 2 (full lines) the pendulum 60 is shown at rest with the tip 72 contacting the bed 28 at a point located at the center of the design area. In such at-rest position the central axis of the receiver 22 is vertical and coaxial with the pendulum rod 62. FIG. 9 shows an exemplary pattern 80 (minute details omitted) inscribed by the pendulum thus positioned; note that the pattern 80 extends generally along a diameter of the circular design area and is symmetrical with respect to the center thereof. As the arrows in FIG. 9 illustrate, rotation of the receiver 22 through a selected angular displacement after pattern 80 is sculptured, will produce a second pattern 80A identical to pattern 80 if the pendulum weight 66 is released from the same position as before. After pattern 80A is sculptured, the viewer may again rotate the receiver 22 and inscribe the repeat pattern 80B, and continue repeating the pattern at the desired angular intervals in accordance with the composite pattern to be created.

FIG. 8 illustrates repetitive subpatterns similar to the main pattern 82 but shorter in length. This composition is created by utilizing the tilt feature previously discussed; the receiver 22 is not rotated. The two subpatterns 82A are inscribed by tilting the pendulum assembly to the same degree in opposite directions to either side of the center position. Likewise, the two outboard subpatterns 82B are created by a more extreme tilted position first in one direction and then the other. It should be understood that when the receiver 22 is tilted, the standards 44 and the entire pendulum assembly likewise tilt so that the at-rest point of contact of the tip 72 with the bed 28 is shifted. Manifestly, the tilting feature may also be employed to center the pendulum for conventional sculpturing in instances where the baseplate 20 is resting on a surface that is not perfectly horizontal.

The composition illustrated in FIG. 10 is more complex and is formed by four subpatterns 84 in respective quadrants of the design area delineated by two orthogonal repeat patterns 86 inscribed with the tip 72 at the centered at-rest position. Accordingly, the composition of FIG. 10 is created through the utilization of both the variable tilt and the rotational capability of the receiver 22. FIGS. 8–10 are merely exemplary as the design flexibility is nearly limitless. It should be understood that the narrow patterns 80, 80A and 80B in FIGS. 9, 82, 82A and 82B in FIG. 8, and 86 in FIG. 10 are inscribed by releasing the pendulum at the edge of the receiver 22 for initial movement along a path either nearly parallel or nearly orthogonal to the primary horizontal axis.

The arrows 88 in FIG. 2 illustrate the swinging movement of the pendulum 60. The primary horizontal axis is provided by line contact of the rocker element 56 with the arch member 50. By virtue of the V-shaped portion 54 within which the element 56 is received, the suspension is quite stable and resistant to accidental dislodging or disengagement of the element 56 from the arch 50. This also is of particular importance herein due to the tiltability of the pendulum assembly, since the horizontal axis in a tilted position may be somewhat inclined with respect to true horizontal (see the broken line illustration in FIG. 2); therefore, the rocker and arch arrangement with the V-shaped portion 54 and the slot 58 mutually captures the two components so they will not become disengaged from each other even in an extreme tilted position of the pendulum assembly.

Having thus described the invention, what is claimed as new and desired to be secured by Letters Patent is:

1. A kinetic sculpture apparatus comprising:

a receiver containing a fine, particulate material presenting a bed thereof;

a pendulum having an upper end and a lower end, the latter presenting a scribe;

means above said receiver suspending said pendulum thereover with said scribe contacting said material at a predetermined point in the bed when the pendulum is at rest, and establishing a primary, generally horizontally disposed axis of swinging movement of the pendulum, said upper end of the pendulum being provided with a secondary coupling connecting the pendulum to said suspension means;

standard means secured to said receiver and extending upwardly to said suspension means to support the same;

a base; and means mounting said receiver on said base spaced thereabove for tilting movement of the receiver, and hence the standard means, to any of a number of positions in which the receiver and standard means are tilted relative to the base and said primary axis is horizontally displaced, whereby said predetermined point of contact of the scribe may be moved to center the point in the bed or locate said point away from the center so that subpatterns may be sculptured.

2. The apparatus as claimed in claim 1, wherein said mounting means comprises a universal connection between said receiver and said base to permit said tilting movement of the receiver in any direction.

3. The apparatus as claimed in claim 1, wherein said receiver has a botton and said mounting means further comprises a stem centrally located on said bottom and depending therefrom to said connection, and wherein said standard means includes a pair of standards each having a generally horizontally extending, lower arm portion radiating from said stem clear of the receiver, and an upright portion extending from said arm portion to said suspension means.

4. The apparatus as claimed in claim 2, wherein said receiver has a central, normally vertical axis extending through said connection, said mounting means further comprising means supporting said receiver above said connection for independent rotation about said central axis through a selected angular displacement, whereby to permit the sculpturing of angularly spaced repeat patterns.

5. The apparatus as claimed in claim 1, wherein said mounting means comprises a ball and socket connection centrally disposed beneath said receiver to permit said tilting movement thereof in any direction.

6. The apparatus as claimed in claim 1, wherein said suspension means includes a member extending from said standard means over said bed and having a flat, generally V-shaped portion above said predetermined point in the bed, and a plate-like rocker element having a slot therein through which said member extends, said V-shaped portion receiving said element in an upright attitude to define said primary axis, said secondary coupling connecting said upper end of the pendulum with said element beneath said slot.

7. The apparatus as claimed in claim 1, wherein said standard means includes a plurality of horizontally spaced standards secured to said receiver.

8. The apparatus as claimed in claim 1, wherein said standard means includes a pair of standards disposed on opposite sides of said receiver.

9. The apparatus as claimed in claim 8, wherein said suspension means includes an arch spanning said pair of standards and a plate-like rocker element having a slot therein, said arch having a generally V-shaped central portion receiving said element in an upright attitude and extending through said slot to define said primary axis, said secondary coupling connecting said upper end of the pendulum with said element beneath said slot.

10. A kinetic sculpture apparatus comprising:

base structure provided with a receiver containing a fine, particulate material presenting a bed thereof;

a pendulum having an upper end and a lower end, the latter presenting a scribe;

means above said receiver suspending said pendulum thereover with said scribe contacting said material, and establishing a primary, generally horizontally disposed axis of swinging movement of the pendulum, said upper end of the pendulum being provided with a secondary coupling connecting the pendulum to said suspension means;

standard means secured to said receiver and extending upwardly to said suspension means to support the same; and means mounting said receiver for independent rotation about a centrally disposed, generally upright axis through a selected angular displacement, whereby to permit the sculpturing of angularly spaced repeat patterns.

11. The apparatus as claimed in claim 10, wherein said standard means includes a pair of standards disposed on opposite sides of said receiver.

12. The apparatus as claimed in claim 11, wherein said suspension means includes an arch spanning said pair of standards.

13. The apparatus as claimed in claim 10, wherein said receiver has a bottom provided with means presenting an internal wall defining a tapered opening aligned with said upright axis, and wherein said mounting means includes said opening and an upstanding, tapered stud received within said opening, said stud and said wall presenting mating, frustoconical surfaces.

14. The apparatus as claimed in claim 10, further comprising a cover for said receiver having a convex lower surface for shaping the bed prior to sculpturing.

15. A kinetic sculpture apparatus comprising:

base structure provided with a receiver containing a fine, particulate material presenting a bed thereof, a pendulum having an upper end and a lower end, the latter presenting a scribe, means above said receiver suspending said pendulum thereover with said scribe contacting said material at a predetermined point in the bed when the pendulum is at rest, and establishing a primary, generally horizontally disposed axis of swinging movement of the pendulum, standard means secured to said receiver and extending upwardly to said suspension means to support the same, and said suspension means including a member extending from said standard means over said bed and having a flat, generally V-shaped portion above said predetermined point in the bed, and a plate-like rocker element having a slot therein through which said member extends with the V-shaped portion thereof receiving said element in an upright attitude to define said primary axis, said upper end of the pendulum being provided with a secondary coupling connected with said element beneath said slot.

16. The apparatus as claimed in claim 15, wherein said standard means includes a pair of standards disposed on opposite sides of said receiver, and wherein said member comprises an arch spanning said pair of standards.

* * * * *

UNITED STATES PATENT AND TRADEMARK OFFICE

CERTIFICATE OF CORRECTION

PATENT NO. : 4,192,072

DATED : March 11, 1980

INVENTOR(S) : THOMAS E. TRUITT

It is certified that error appears in the above—identified patent and that said Letters Patent is hereby corrected as shown below:

Column 5,
Claim 3, line 54, change "1" to --2-- so that claim 3 depends from claim 2, not from claim 1.

Column 5,
Claim 3, line 55, change "botton" to --bottom--.

Signed and Sealed this

*Twenty-fourth* Day of *June 1980*

[SEAL]

*Attest:*

SIDNEY A. DIAMOND

*Attesting Officer*

*Commissioner of Patents and Trademarks*